US007779976B2

(12) United States Patent
Mangano

(10) Patent No.: US 7,779,976 B2
(45) Date of Patent: Aug. 24, 2010

(54) VERSATILE AND RECONFIGURABLE LUGGAGE

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 457 days.

(21) Appl. No.: 11/517,526

(22) Filed: Sep. 8, 2006

(65) Prior Publication Data

US 2008/0083592 A1 Apr. 10, 2008

(51) Int. Cl.
*A45C 13/02* (2006.01)
*A45C 9/00* (2006.01)

(52) U.S. Cl. ..... 190/110; 190/6

(58) Field of Classification Search ..... 190/9, 190/13 R, 13 H, 18 R, 19, 102, 106, 109, 190/110, 3, 6, 7, 33; 229/913; 150/106, 150/112, 113
See application file for complete search history.

(56) References Cited

U.S. PATENT DOCUMENTS

| | | | | | |
|---|---|---|---|---|---|
| 823,700 | A | | 6/1906 | Sayer, Jr. | |
| 923,807 | A | | 6/1909 | Bonsall | |
| 944,593 | A | | 12/1909 | Bonsall | |
| 1,057,195 | A | | 3/1913 | Wheary | |
| 1,137,579 | A | * | 4/1915 | Cohn | 190/110 |
| 1,314,556 | A | | 9/1919 | Wheary | |
| 1,694,470 | A | | 12/1928 | Hursh | |
| 1,725,947 | A | * | 8/1929 | Woodward | 190/13 R |
| 1,728,212 | A | | 9/1929 | McCollum | |
| 1,819,274 | A | * | 8/1931 | Wheary | 190/13 R |
| 1,845,822 | A | * | 2/1932 | Wheary | 190/13 R |
| 1,870,305 | A | * | 8/1932 | Wheary | 190/13 F |
| 1,964,706 | A | * | 6/1934 | Williams | 190/13 R |
| 2,244,887 | A | | 6/1941 | Manley | |
| 2,533,333 | A | | 12/1950 | Kitson | |
| 3,381,782 | A | * | 5/1968 | Ikelheimer | 206/593 |
| 3,388,777 | A | * | 6/1968 | Nolan | 190/109 |
| 3,861,504 | A | | 1/1975 | McGraw | |
| 3,869,034 | A | | 3/1975 | Thornton, Jr. | |
| 4,609,084 | A | * | 9/1986 | Thomas | 190/110 |
| 4,738,340 | A | | 4/1988 | Crespi | |
| 4,941,603 | A | * | 7/1990 | Creamer et al. | 224/148.3 |
| D315,986 | S | * | 4/1991 | Blevins | 3/279 |
| 5,042,664 | A | * | 8/1991 | Shyr et al. | 206/579 |
| 5,096,030 | A | | 3/1992 | Espinosa et al. | |
| 5,295,565 | A | * | 3/1994 | Latshaw | 190/18 A |
| 5,628,397 | A | | 5/1997 | Ham | |
| 5,833,114 | A | * | 11/1998 | Linnell | 220/531 |
| 5,896,962 | A | | 4/1999 | Smith et al. | |
| 5,931,551 | A | | 8/1999 | Wang | |
| 6,009,995 | A | * | 1/2000 | Speck | 206/315.9 |
| 6,076,641 | A | | 6/2000 | Kinzer et al. | |
| 6,102,569 | A | * | 8/2000 | Wang | 383/104 |

(Continued)

FOREIGN PATENT DOCUMENTS

WO WO 2005/079619 A1 * 9/2005

*Primary Examiner*—Sue A Weaver
(74) *Attorney, Agent, or Firm*—Kenyon & Kenyon LLP

(57) ABSTRACT

An item of luggage is provided that has foldable shelves and collapsible drawers. The drawers and shelves may be folded relatively flat and stored in the main housing of the luggage when not in use. The luggage may have a cover support to hold the cover of the luggage open at various angles and under various loads when the cover is open.

2 Claims, 17 Drawing Sheets

U.S. PATENT DOCUMENTS

| | | | | |
|---|---|---|---|---|
| 6,450,599 | B1 | 9/2002 | Mamuyac | |
| 6,481,574 | B1 | 11/2002 | Pakosh | |
| 6,533,086 | B1 * | 3/2003 | Waddell et al. | 190/18 A |
| 6,640,944 | B2 * | 11/2003 | Adams | 190/110 |
| D501,601 | S | 2/2005 | Platte, III | |
| 6,923,516 | B2 | 8/2005 | Sheng-Bin | |
| D515,813 | S | 2/2006 | Roberson | |
| 2002/0023812 | A1 * | 2/2002 | Bernbaum et al. | 190/111 |
| 2005/0029911 | A1 | 2/2005 | Sheng-Bin | |
| 2005/0098403 | A1 | 5/2005 | McIntyre | |
| 2005/0126872 | A1 | 6/2005 | Dror | |
| 2005/0145458 | A1 | 7/2005 | Cohen | |
| 2006/0096821 | A1 | 5/2006 | McKaba | |

* cited by examiner

VERSATILE AND RECONFIGURABLE LUGGAGE

FIELD OF THE INVENTION

The present invention relates to luggage. More specifically, the application relates to versatile and reconfigurable luggage.

BACKGROUND

Luggage may be used by travelers and others to transport clothes and toiletries between destinations. An item of luggage often has a single compartment for storing clothing, toiletries, travel necessities, and other items. When these items are placed in this compartment they are able to move and shift throughout the compartment during travel. This movement allows the various items placed in the luggage to commingle with each other. It also allows items, such as folded shirts, which were previously placed in a single location and, perhaps, stacked on one another, to become wrinkled and misshapen. This movement may occur during transit as well as before and afterwards. When arriving at a destination, after the contents of the luggage have been mixed and thrown about the traveler will need to gather the items that have moved and refold or otherwise reassemble the clothes that have been placed in the luggage. Once unpacked, these items may be placed in the appropriate places at the new location. This may include, placing the folded garments in a dresser. This cycle of packing, transport, regrouping, and unpacking may be repeated numerous times during a journey and innumerable times during the lifetime of the luggage.

SUMMARY OF THE INVENTION

Embodiments of the present invention may include luggage having interior shelves. In an embodiment, an item of luggage has a main compartment that may store objects such as clothing, toiletries, and other items. A plurality of foldable shelves may be disposed within the main compartment. One edge of each of the shelves may be connected to one interior surface of the main compartment, such that the shelves may be folded flat against the inner surface. For example, the shelves may be hingeably attached to the back surface (i.e., opposite the cover) of the main compartment. The shelves may be folded flat when the item of luggage is packed (i.e., items are placed in the main compartment) by a traveler. The traveler may later place the shelves in a second, unfolded or extended position, for storage and better organizations of the items stored in the luggage. For example, when arriving at a new location, the traveler may remove items stored in the luggage, arrange the shelves in the expanded position, and place the items in a convenient location on the shelves. That is, the luggage may be used as a portable armoire, dresser or shelf unit.

In an embodiment, the item of luggage may include one or more collapsible drawers that can be placed on the shelves when the shelves are expanded (i.e., not folded flat against an interior surface of the luggage). The drawers may be made of, for example, cloth, nylon, or another flexible material. A removable rigid bottom may be used in each drawer to define the shape of the drawer and provide support for items placed in the drawers. Drawers of various sizes may be used, to allow for a variety of objects to be stored in the luggage. The drawers may be stored in the luggage when collapsed, for example prior to arriving at a new location, and may later be assembled for use at the new location. The luggage may contain a partition that has been sized to stow the drawers in a collapsed or partially collapsed condition during transit. The drawers may also be assembled and used to store objects during travel, for example to separate different type of items stored in the luggage. The drawers may assembled and placed on the shelves when they are being used to store and organize items during travel.

In an embodiment, an item of luggage according to the invention may be used as a portable chest of drawers, armoire, etc. It may be desirable to have a mechanism for keeping the cover of the luggage open during use. For example, a storage bag or other unit may be disposed on the inside surface of the cover, the weight of which may cause the cover to close undesirably. Similarly, it may be desirable for the cover to be maintained in an open position when the collapsible drawers are used. An extendable support may be disposed on the inner surface of the cover. When the cover is open, the support may be placed in an extended position such that it contacts the surface on which the luggage is resting. The support may be angled away from the cover to provide additional support or maintain the cover at a specific angle relative to the main compartment of the luggage. When the cover is to be closed, the support may be folded against the cover to allow the luggage to be closed without interference. This support may be coupled to the lid with a hinge and may be secured in a stowed position and an extended position by one or more fasteners.

The traveler may have packed the drawers of the luggage such that there is no need to unpack at the destination. The traveler may simply select the needed clothes and other items from the drawers while leaving the remaining items. Using the invention in this way saves time upon arrival and allows the traveler to begin spending time completing tasks on the travel itinerary or agenda.

DETAILED DESCRIPTION

Figure 1:
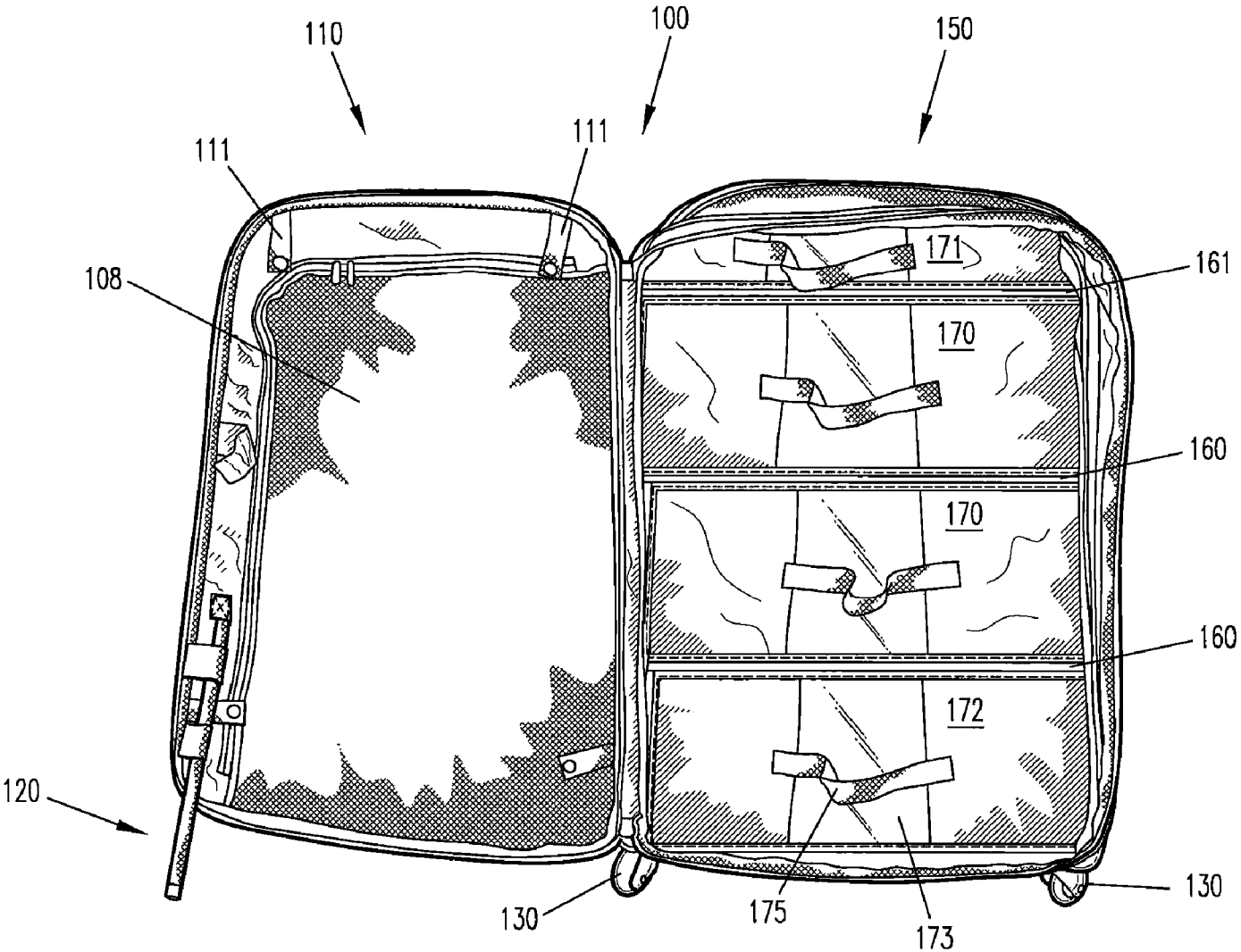
FIG. 1 shows a front view of an item of luggage in an open position according to an embodiment of the present invention.
Figure 2:
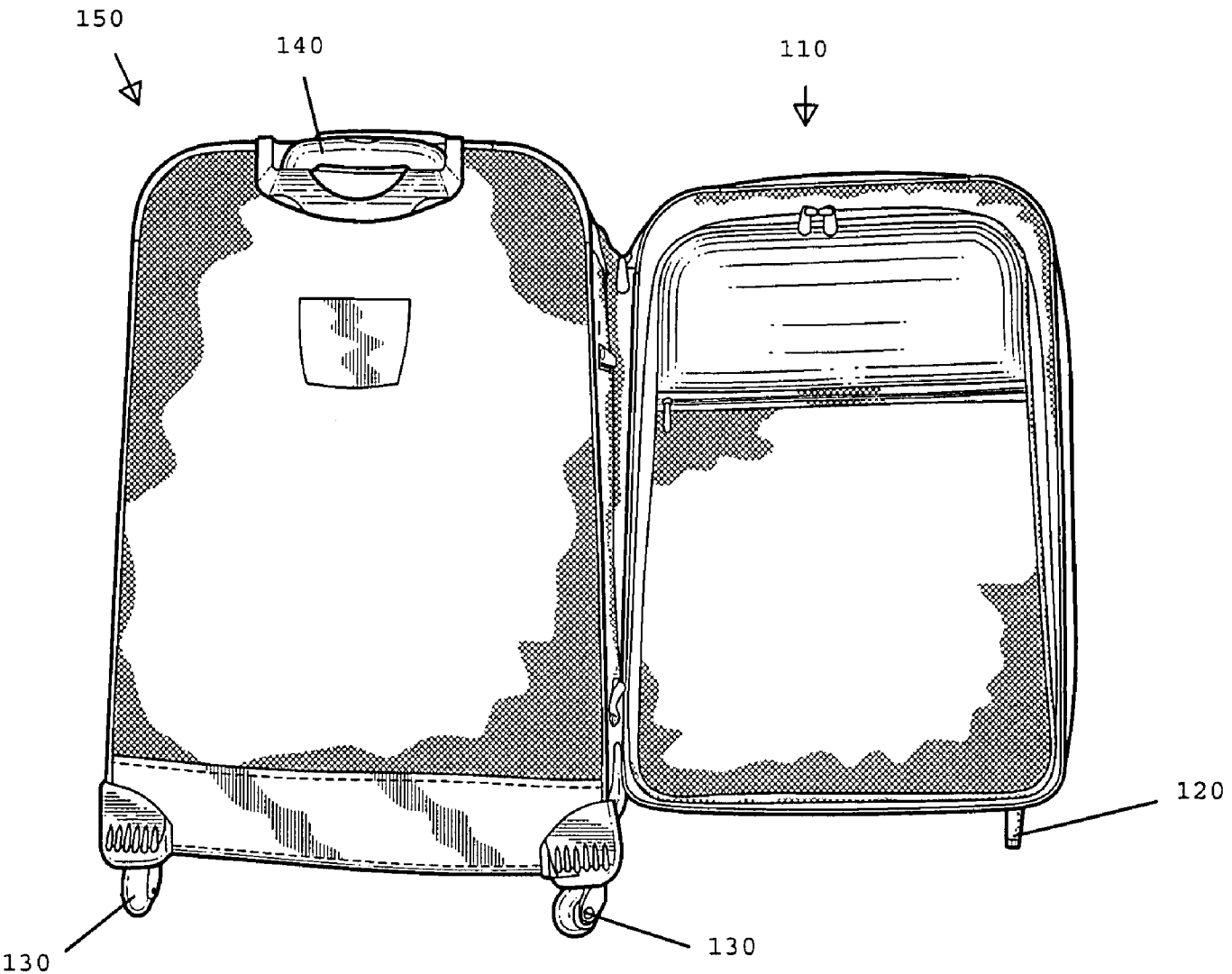
FIG. 2 shows a rear view of an item of luggage in an open position according to an embodiment of the present invention.
Figure 3:
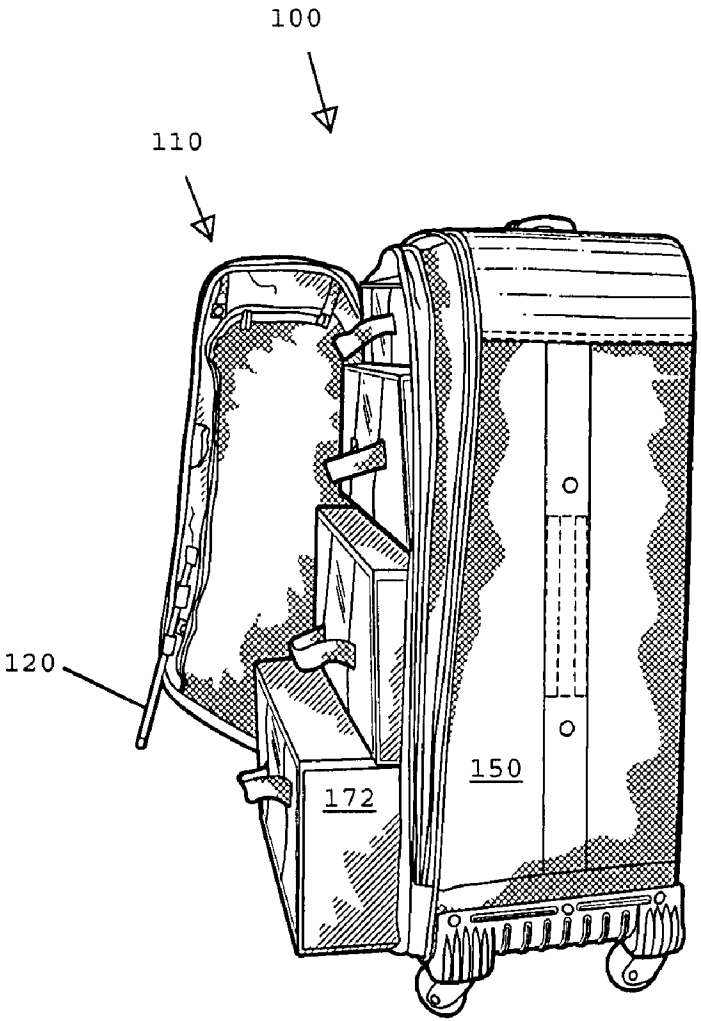
FIG. 3 shows a side view of an item of luggage in an open position according to an embodiment of the present invention.

An item of luggage 100 with the cover open according to an embodiment of the invention is shown in FIGS. 1-4. These figures show, respectively, front, back, left, and right views of an item of luggage 100 according to the invention. The luggage 100 comprises a cover 110 and a main housing 150. The cover 110 may include connectors 111 for attaching additional compartments or other storage to the cover 110 using snaps, Velcro®, or similar fasteners. In FIG. 1, for example, a screen mesh 108 is coupled to the cover 110 with the connectors 111.

An extendable support 120 may be attached to the cover 110 in accord with the invention. The support 120 may be attached to the interior surface of the cover 110, allowing the support 120 to be contained in the luggage when the cover is closed. When in an extended position, as shown in FIG. 1, the support 120 may prevent the cover 110 of the luggage from closing. For example, if an additional storage unit is attached to the cover 110, as previously described, the weight of items stored in the unit may undesirably cause the cover to close. By extending the support 120 so that it contacts the surface on which the luggage 100 rests, the cover 110 may be held open. In an embodiment the support 120 may be hingeably attached to the cover such that it may be placed at a variety of angles with respect to the cover. This may allow for adjustment due to differing amounts of weight placed on the cover, uneven flooring, or other environments. Thus, not only can the support be held tightly against the cover, it may also extend away from it depending upon what reactive force is required to hold the cover in an open position. The support is described further with reference to FIGS. 5-6, below.

The luggage may further comprise foldable shelves 160 and collapsible drawers 170. Each collapsible drawer may be configured to rest on and be supported by a foldable shelf For example, a collapsible drawer 171 may rest on and be supported by a foldable shelf 161. A drawer 172 may also be configured to rest on the bottom surface of the main housing 150 when the luggage is in an upright position as shown. Luggage according to the invention may have various numbers of shelves and drawers. For example, an item of luggage intended to transport many small items may include more, but smaller, collapsible drawers; each drawer may also include multiple dividers. An item of luggage intended to transport larger items, such as large items of clothing, may have fewer, but larger drawers. Other configurations and combinations are possible. For example, rather than having a single drawer on each shelf, two drawers may be placed on the shelves.

The collapsible drawers 170 may be made of cloth, nylon, or other flexible materials. In an embodiment, the drawers have rigid panels in some or all of the sides and/or bottom. The drawers may be reinforced on their top and side edges to increase their durability. As described below, a removable rigid bottom may be used to give shape and support to the drawer. A portion of a collapsible drawer may also be made of a clear material, such as plastic, to allow for viewing of the contents of the drawer without removing the drawer from the main housing. This window may be made of other materials as well. A "window" 173 may be disposed on the front of the drawer to allow for viewing of the drawer's contents. By being able to view the contents of the drawer a traveler can avoid the need for searching through the entire piece of luggage to find a certain item. Likewise, he or she confirm that the luggage contains everything that needs to be packed. This confirmation can occur prior to beginning the trip as well as throughout the entire journey, for example when the traveler leaves each destination along the way. The drawers may also have handles 175 positioned on one or more faces of the drawer.

In an embodiment, moveable casters 130 may be disposed on the exterior bottom surface of the luggage. The casters may be configured so as to move freely through 360 degrees of motion, i.e., the wheels of each caster may independently be placed in any position where each wheel is perpendicular to the exterior bottom surface. This may allow the luggage to be transported in an upright position. In an embodiment, the luggage may include an extendable handle 140. The handle may be disposed within a second compartment of the luggage, such that it may be stored within the compartment when not in use.

Figure 4:
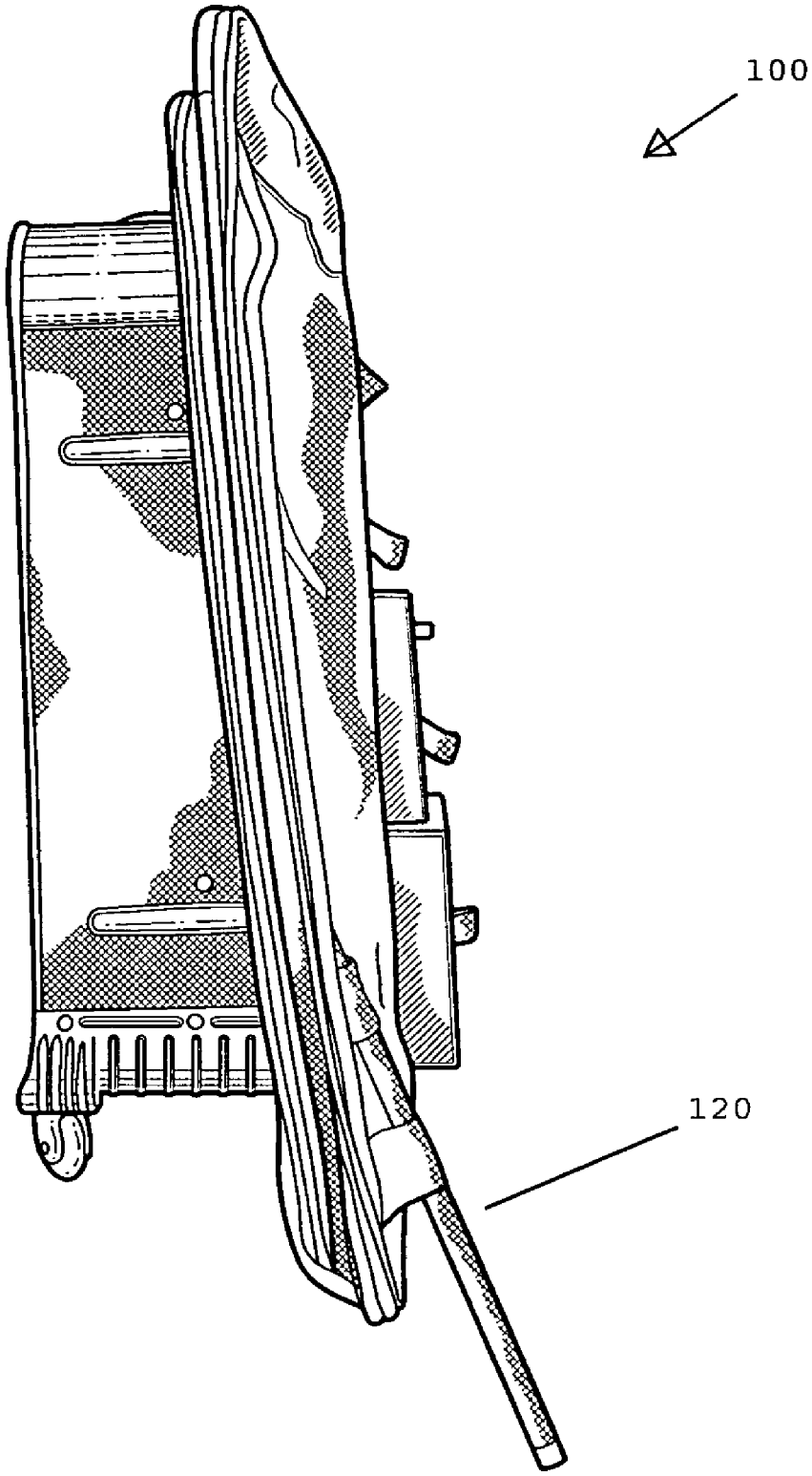
FIG. 4 shows a side view of an item of luggage in an open position according to an embodiment of the present invention.
Figure 5:
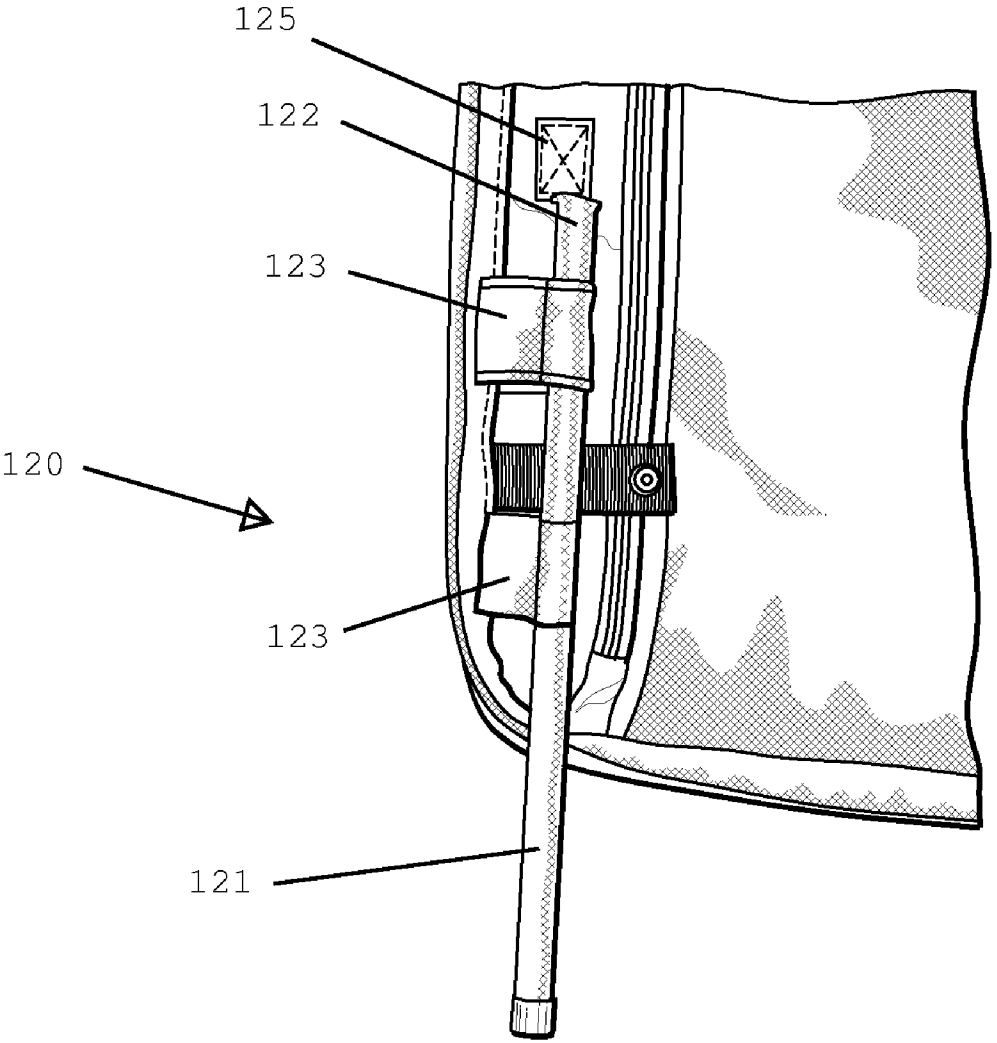
FIG. 5 shows an enlarged view of a cover support in an extended position according to an embodiment of the present invention.

FIG. 5 shows an extendable cover support 120 according to the invention. The support may include a rigid member 121 attached to the interior surface of the cover at a hinge 125 by one end 122. Fasteners 123 may also be attached to the interior surface of the cover. When the extendable support 120 is in an extended position as shown in FIG. 5, the fasteners 123 may be secured to or around the rigid member 121. Such a configuration may prevent undesired movement of the support and/or allow for variable placement of the rigid member 121. For example, the fasteners 123 may comprise straps of cloth, nylon, or other material, with Velcro® attached to a surface of each strap. The fasteners may then be wrapped around the rigid member, and the position of the support adjusted by adjusting the length of each fastener. For example, FIG. 4 shows the support placed such that it forms an angle with the cover 110. In such a configuration, the bottom fastener may be made longer than the top fastener, allowing the bottom of the rigid member 121 to be further away from the plane defined by the cover 110 than the top of the member. Other configurations are possible. For example, by tightly securing the member 121 to the cover 110 with several fasteners 123, the support 120 may be configured such that it is parallel to the cover 110 (i.e., extends straight down to the surface on which the luggage rests). Moreover, the fasteners may have various connection points, which allow them to secure and hold the support 120 at various angles with respect to the cover.

Figure 6:
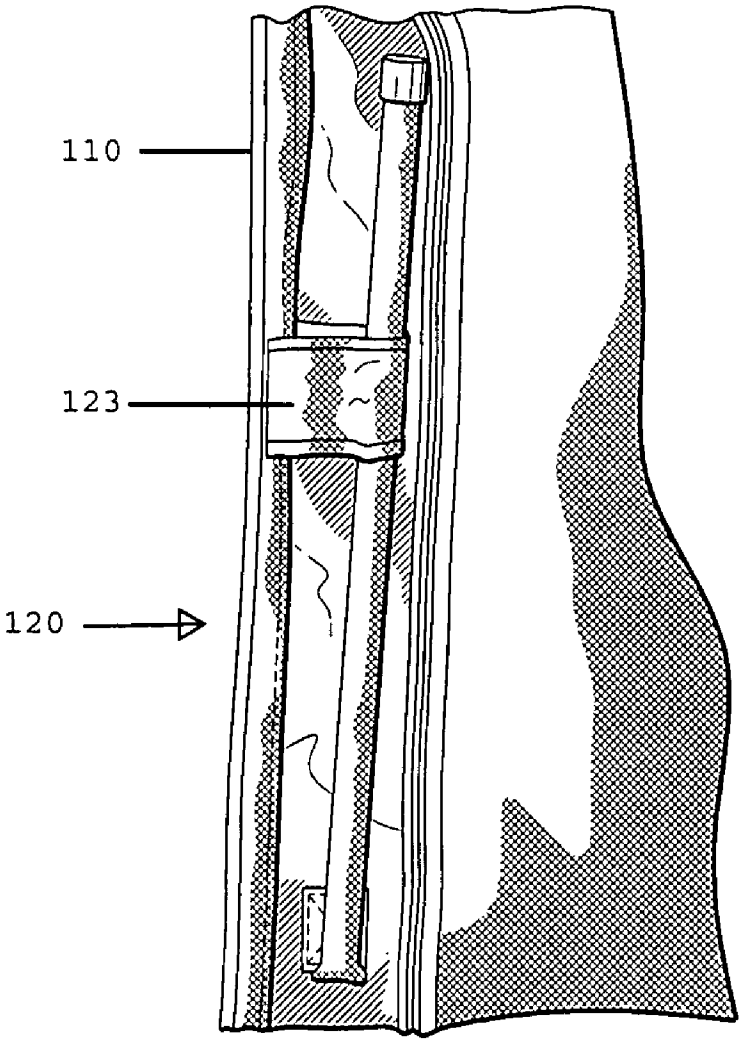
FIG. 6 shows an enlarged view of a cover support in a folded position according an embodiment of the present invention.

FIG. 6 shows an extendable cover support 120 in a folded position according to the invention. When not in use, such as when the cover 110 of the luggage is to be closed, the support 120 may be secured to the cover. One or more fasteners 123 may be used to secure the support in place, such as be attaching to or around the rigid member 121. The support 120 may be secured firmly against the inside cover by the fasteners 123.

Figure 7:
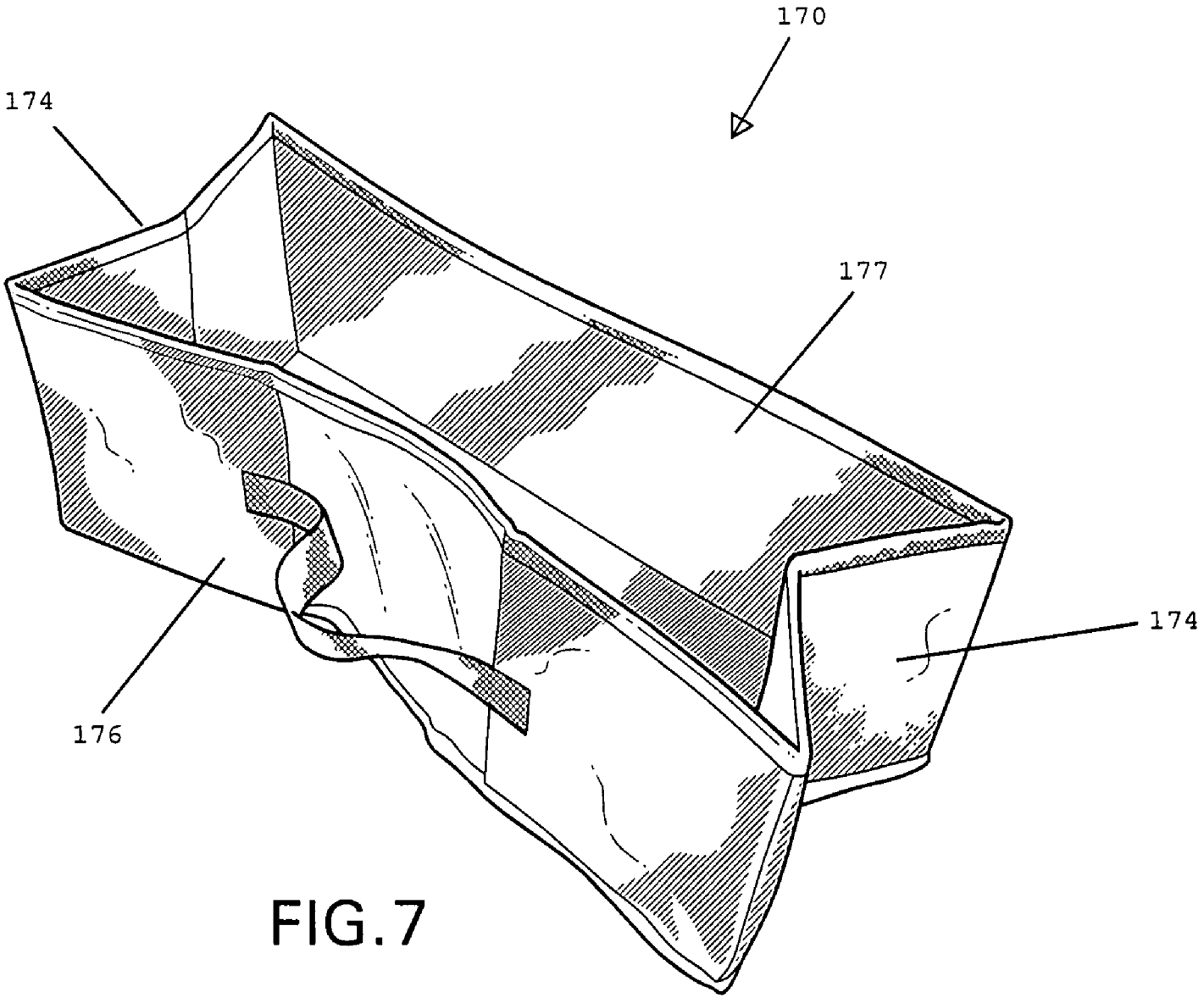
FIG. 7 shows a perspective view of a collapsible drawer in a partly-collapsed configuration according to an embodiment of the present invention.

FIG. 7 shows a collapsible drawer 170 in a partly-collapsed configuration according to the invention. In an embodiment, the sides 174 and bottom of the drawer may be folded inward, allowing the drawer to be folded relatively flat. This may allow the drawer to be stored, for example in the main housing of the luggage when not in use or during transport to a new location. A removable rigid bottom panel (not shown) may be used to provide additional support. The sides 174, bottom, front panel 176, and back panel 177 may have rigid panels to provide additional structure and support to the drawer when in an expanded configuration. Multiple panels may be used to allow for the drawer to be folded as shown in FIG. 7.

Figure 8:
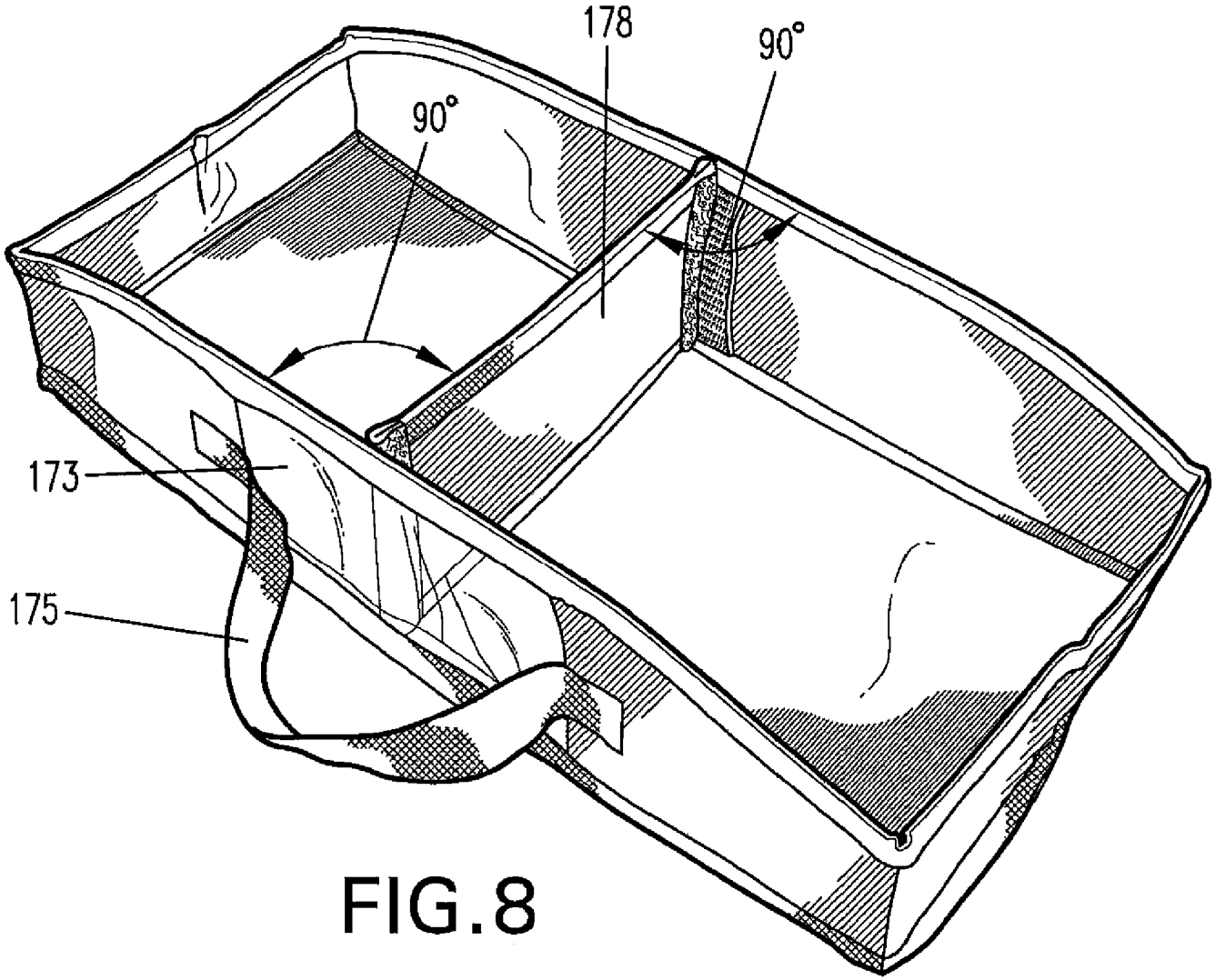
FIG. 8 shows a perspective view of a collapsible drawer in an expanded configuration according to an embodiment of the present invention.

FIG. 8 shows a collapsible drawer 170 in a fully-expanded configuration according to the invention. As previously described, the sides, bottom, front and back of the drawer may be a flexible material and may include rigid panels. One or more dividers 178 may be used to separate the drawer into multiple compartments. Such dividers may be attached to the inside surfaces of the drawer, for example via snaps, Velcro®, or other fasteners. The dividers may then be removed when the drawer is configured in the collapsed position, allowing for storage of the drawer and any dividers. The Velcro® may be placed at the end of the dividers as shown in the figure such that it mates with Velcro® placed on the walls of the drawer.

Figure 9:
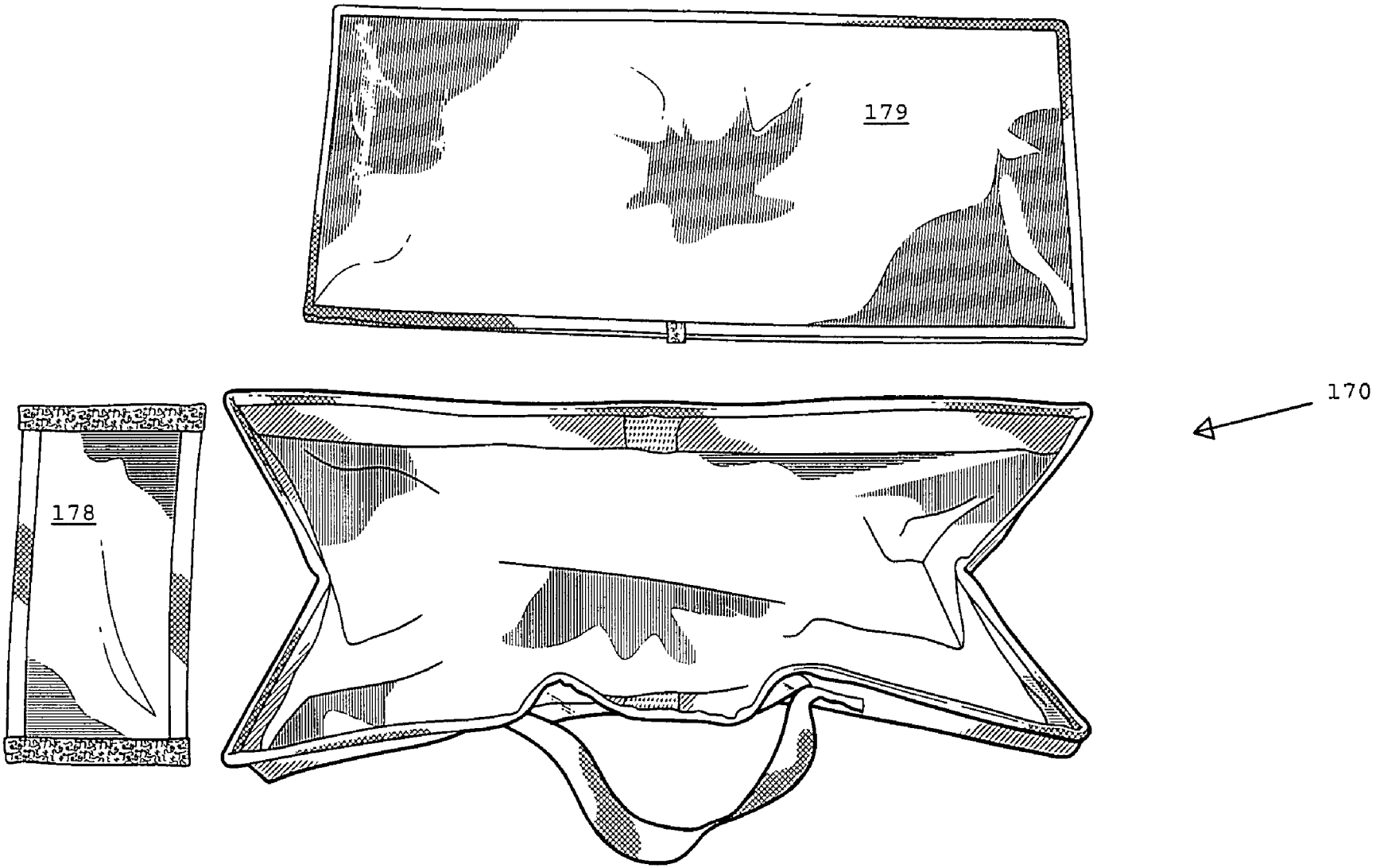
FIG. 9 shows a top view of various components of a collapsible drawer according to an embodiment of the present invention.
Figure 10:
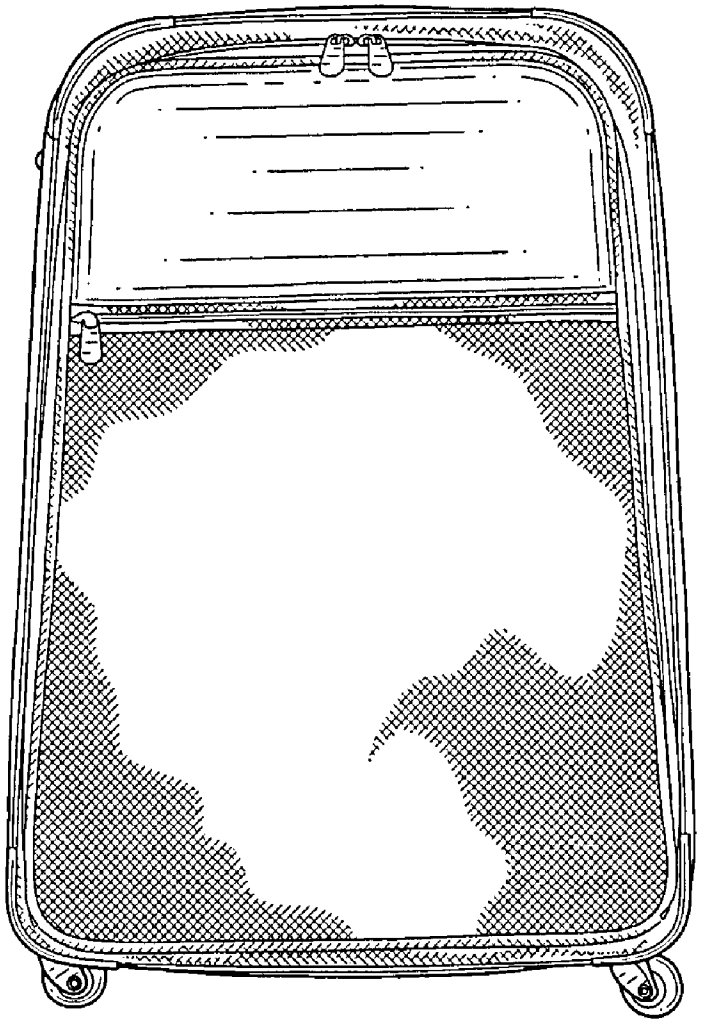
FIG. 10 shows a front view of an item of luggage with the cover in a closed position according to an embodiment of the present invention.
Figure 11:
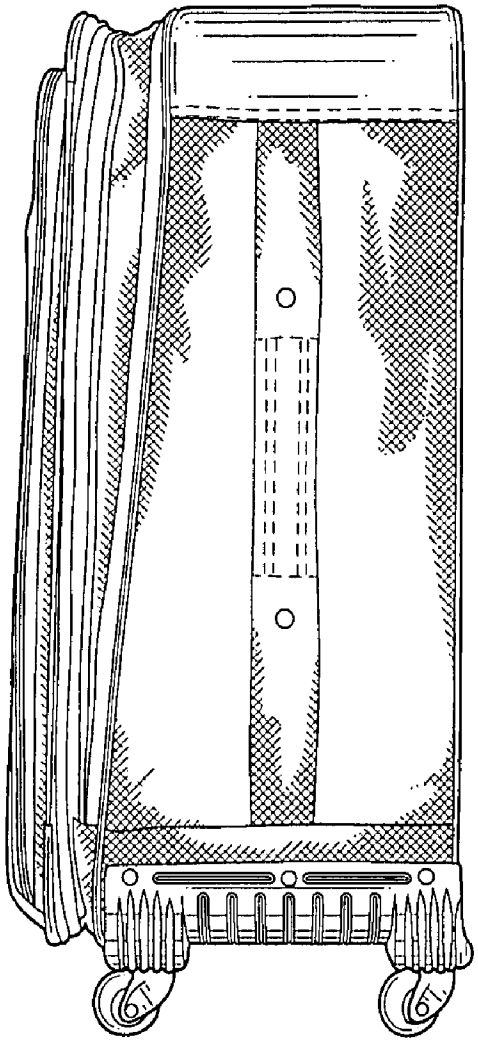
FIG. 11 shows a right side view of an item of luggage with the cover in a closed position according to an embodiment of the present invention.
Figure 12:
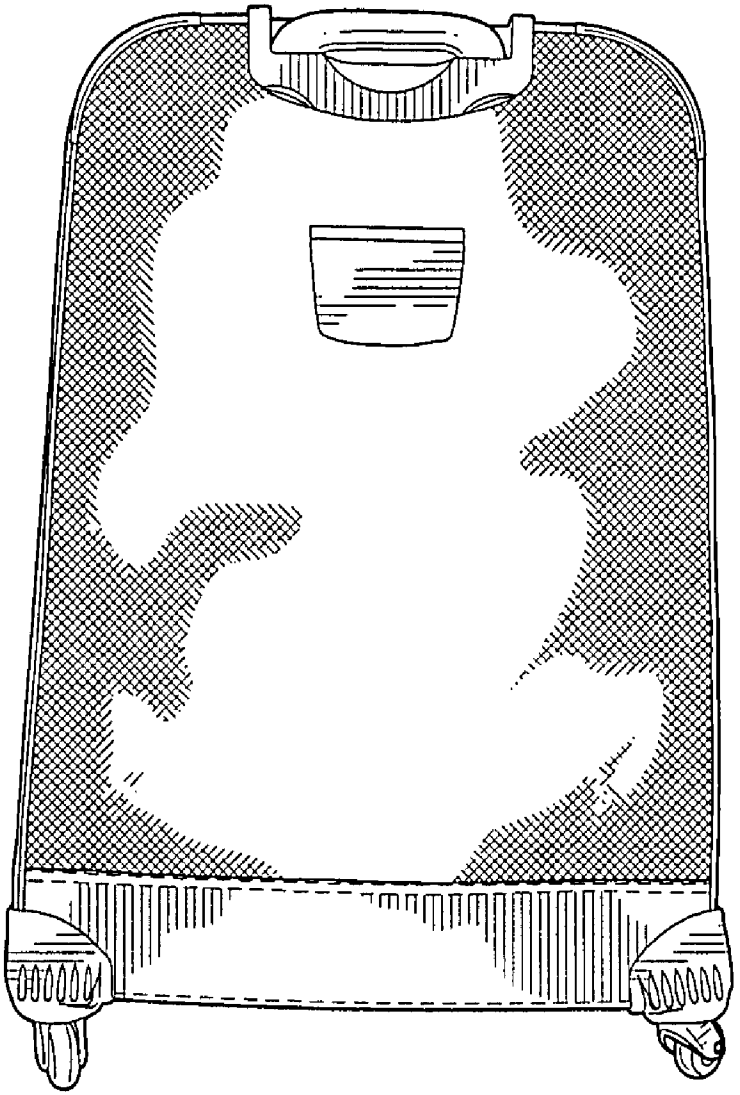
FIG. 12 shows a rear view of an item of luggage with the cover in a closed position according to an embodiment of the present invention.
Figure 13:
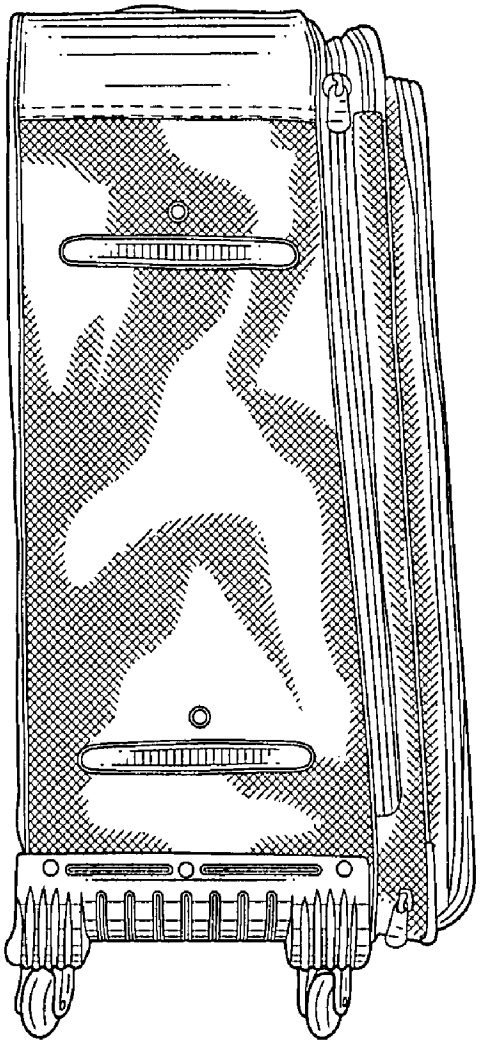
FIG. 13 shows a left side view of an item of luggage with the cover in a closed position according to an embodiment of the present invention.

FIG. 9 shows a top view of a collapsible drawer 170 in a partly-collapsed configuration. A rigid bottom panel 179 and a divider 178 may be removed from the bottom of the drawer, allowing the drawer to be folded as previously described.

FIGS. 10-13 show, respectively, front, left, back and right views of an item of luggage according to the invention when the cover is in a closed position. As previously described, a cover support and one or more collapsible drawers may be stored in the main housing of the luggage when the cover is in a closed position.

Figure 14:
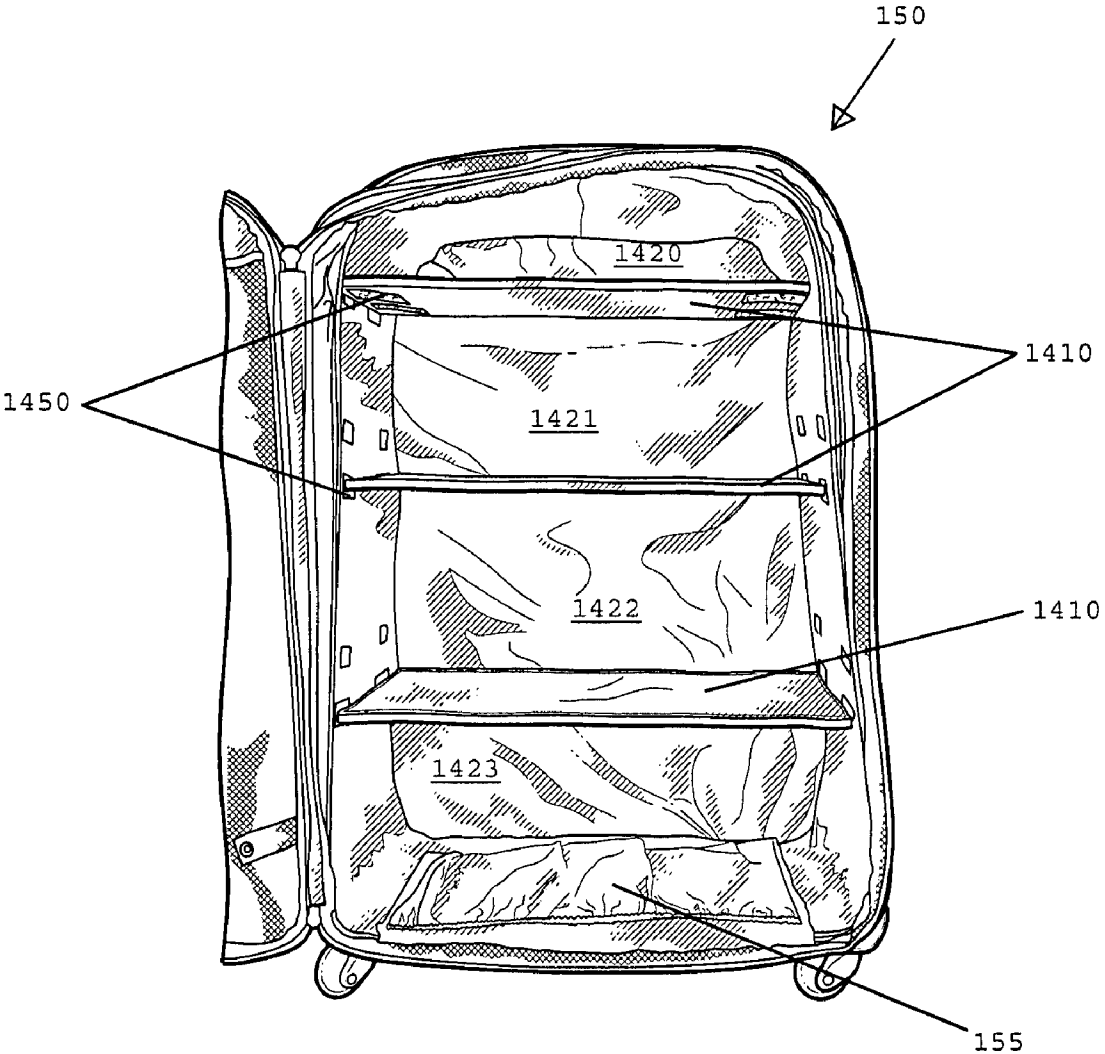
FIG. 14 shows a front view of the main compartment of an item of luggage with foldable shelves in an expanded position according to an embodiment of the present invention.
Figure 15:
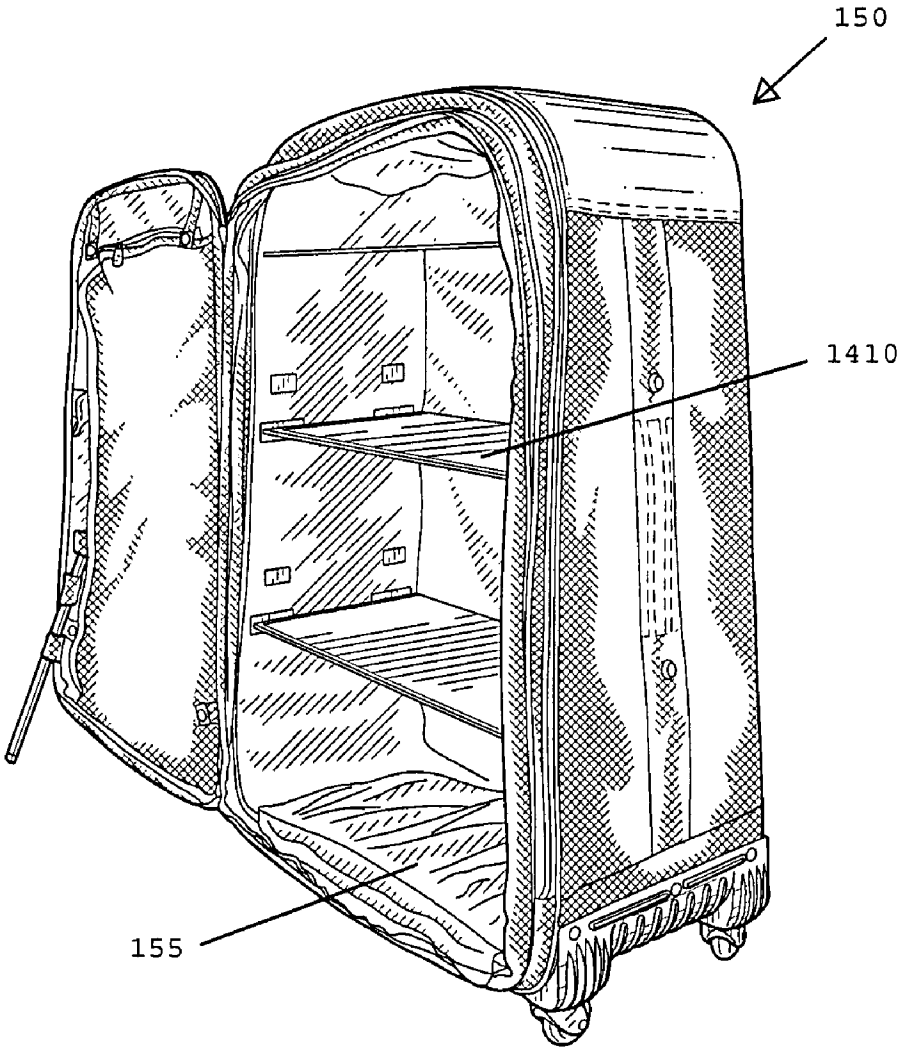
FIG. 15 shows a perspective view of the main compartment of an item of luggage with foldable shelves in an expanded position according to an embodiment of the present invention.

FIGS. 14-15 show front and perspective views, respectively, of an item of luggage having foldable shelves according to an embodiment of the invention. Any number of shelves may be used; FIGS. 14-15 show an example having three shelves. Foldable shelves 1410 may be disposed in the main housing 150 of the luggage. The shelves may be hingeably attached to an interior surface of the main housing, such as the back. Fasteners 1450 may be attached to one or more of the interior surfaces of the main housing. When the shelves are in the extended position as shown, the fasteners 1450 may be attached to the foldable shelves 1410 to provide additional support to each shelf. The fasteners may be snaps, Velcro®, or other fasteners. These fasteners may be configured to secure the shelves perpendicular to the back surface as well as at different angles from the back surface as well. By allowing the shelves to be secured in non-orthogonal orientations, the luggage is better suited to accept oddly shaped items for transport.

When collapsible drawers are used, each drawer may be configured to fit within one of the spaces 1420-1423 defined by an adjacent pair of shelves or an interior surface of the main housing 150 and a shelf. For example, a collapsible drawer may be configured to have a height, width, and depth approximately equal to or less than the space 1420. The shelves may be placed such that each space is the same, or the spacing may be varied to allow for shelf spaces and/or drawers of varying sizes.

Figure 16:
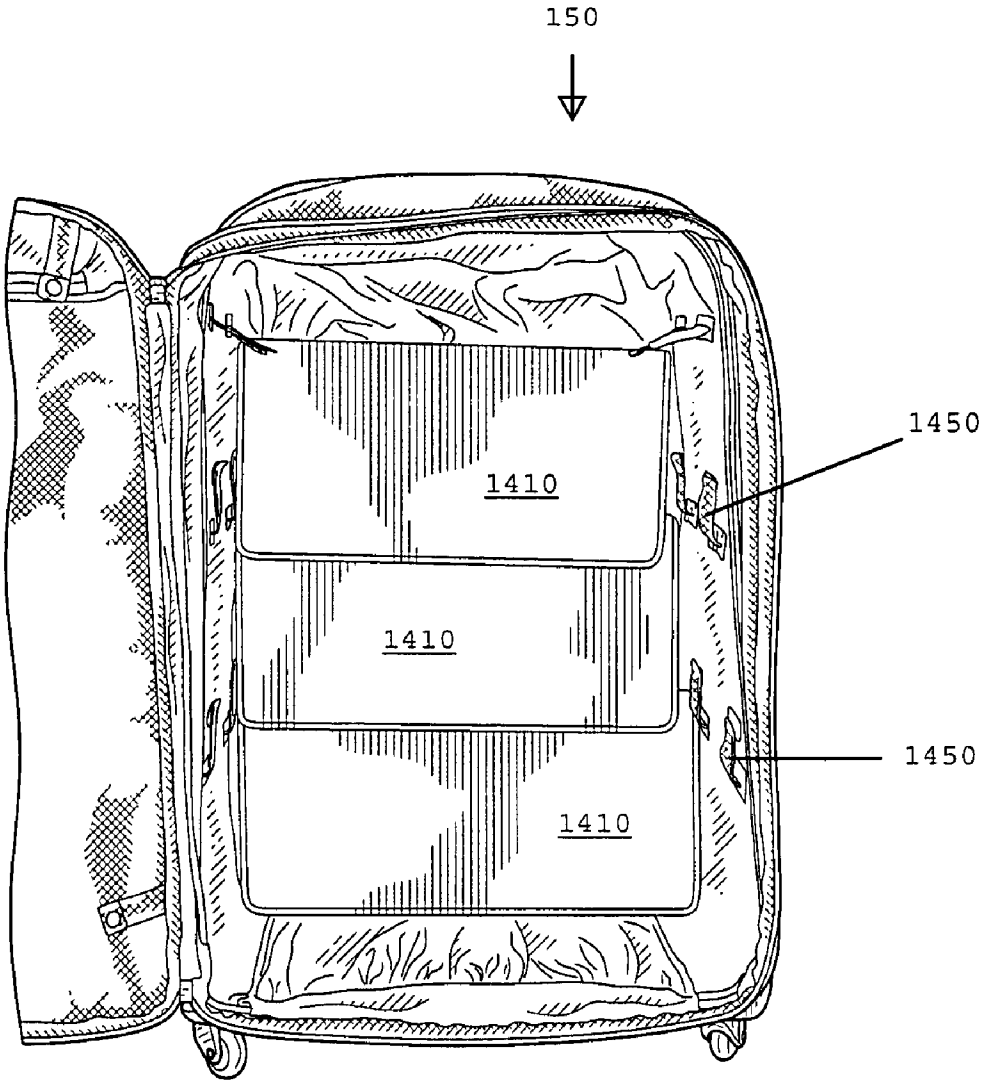
FIG. 16 shows a front view of the main compartment of an item of luggage with foldable shelves in a folded position according to an embodiment of the present invention.
Figure 17:
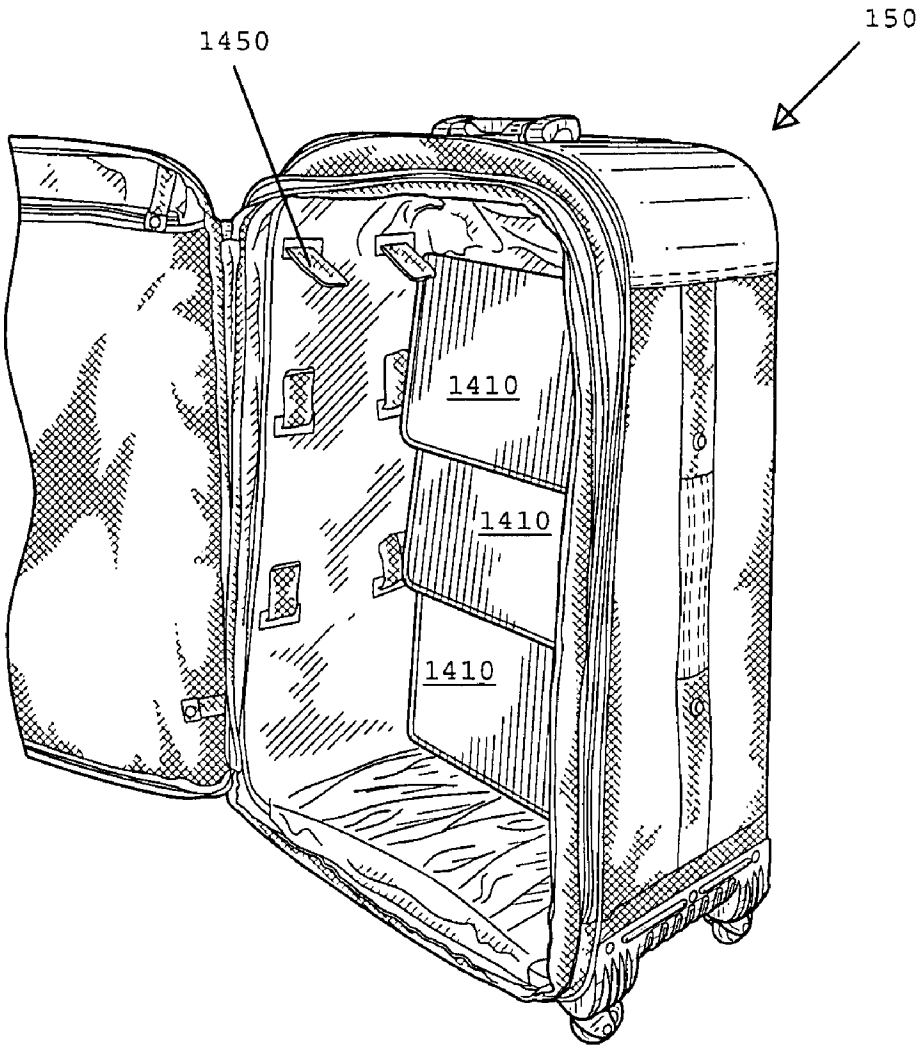
FIG. 17 shows a perspective view of the main compartment of an item of luggage with foldable shelves in a folded position according to an embodiment of the present invention.

FIGS. 16-17 show front and perspective views, respectively, of an item of luggage having foldable shelves according to an embodiment of the invention, with the shelves in a folded position. Each shelf 1410 may be folded relatively flat against the surface to which one edge of the shelf is hingeably connected. In the example shown in FIGS. 16-17, each shelf may be folded flat against the back interior surface of the main compartment. Fasteners 1450 may also be attached to a surface of the main housing. For example, if Velcro® fasteners are used, a corresponding fastener may be attached to the inner surface, allowing each fastener to be secured relatively flat against the surface to which it is attached. This may prevent the fasteners from interfering with the placement of items in the main compartment, and allow more space for items to be placed in the main compartment. Each shelf 1410 may be independently configurable. That is, it may be desirable to fold only some of the shelves against the interior surface of the main housing, while positioning one or more shelves in an expanded position.

A drawer storage compartment 155 is also shown in FIGS. 14-17. The compartment 155 may be configured to accept the collapsible drawers in a fully collapsed configuration for storage. This may allow the collapsible drawers to be stored in the main housing 150 without interfering with placement of other items in the main housing.

While the present invention is described with respect to particular examples and preferred embodiments, it is understood that the present invention is not limited to these examples and embodiments. For example, many of the materials and structures described herein may be substituted with other materials and structures without deviating from the spirit of the invention. Various configurations of shelves, drawers, and other structures may be used to create a variety of luggage configurations. Moreover, the various components of the preceding embodiments may be combined in whole or in part with one another in accord with the teachings of the invention. The invention, as claimed, therefore includes variations from the particular examples and preferred embodiments described herein.

What is claimed is:

1. An item of luggage comprising:

a main housing having a top, a bottom, a back wall, and two side walls;

a cover hingeably attached to an edge of one of the side walls of the main housing, the cover moveable from a first closed position to a second open position; and a plurality of foldable shelves disposed within the main housing, each shelf hingeably attached to the back wall of the main housing, each shelf moveable from a first folded position to a second extended position, each shelf having a width and depth, each of the plurality of foldable shelves is securable to at least one of the walls of the main housing when the foldable shelf is in the second extended position;

a plurality of foldable drawers, each foldable drawer foldable from a first expanded configuration to a second folded configuration, each foldable drawer configured to rest on one of the plurality of foldable shelves when the drawer is in the first expanded configuration, wherein each foldable drawer comprises a front window, the front window is made of a clear material to allow for viewing of the contents of the drawer without removing the drawer from the main housing;

an extendable support attached to the cover, the extendable support pivotable about a hinge from a first retracted position to a second extended position, wherein when the cover is in the second open position and the extendable support is in the second extended position, the extendable support contacts the surface on which the luggage rests, and a plurality of fasteners are disposed on the interior surface of the cover, the fasteners configured to receive the extendable support when the extendable support is in the first retracted position, wherein at least one of the fasteners has an adjustable length to secure and hold the extendable support at various angles with respect to the cover in the second extended position;

a divider having a first edge and a second edge, the divider configured to fit in the foldable drawer when the foldable drawer is in the first expanded configuration, wherein each of the plurality of foldable drawers comprises a removable rigid bottom, and wherein other than the removable rigid bottom each of the foldable drawers is flexible.

2. A suitcase configured for travel having a plurality of wheels and an extendable and retractable handle, the suitcase comprising:

a main housing having a top, a bottom, a back wall, and two side walls;

a cover having an exterior surface and an interior surface, the cover hingeably attached to an edge of one of the side walls of the main housing, the cover moveable from a first closed position to a second open position;

a plurality of foldable shelves disposed within the main housing, each shelf hingeably attached the back wall of the main housing, each shelf moveable from a first folded position to a second extended position, each shelf having a width and depth;

an extendable support attached to the cover, the extendable support pivotable about a hinge from a first retracted position to a second extended position, a plurality of fasteners are disposed on the interior surface of the cover, the fasteners configured to receive the extendable support when the extendable support is in the first retracted position, wherein at least one of the fasteners has an adjustable length to secure and hold the extendable support at various angles with respect to the cover in the second extended position;

a plurality of foldable drawers, each foldable drawer foldable from a first expanded configuration to a second folded configuration;

wherein:

each foldable drawer comprises a front window, the front window is made of a clear material to allow for viewing of the contents of the drawer without removing the drawer from the main housing;

when the cover is in the second position and the extendable support is in the second position, the extendable support contacts the surface on which the suitcase rests;

each of the plurality of foldable drawers comprises a removable rigid bottom;

each of the foldable drawers is flexible other than the removable rigid bottom;

each foldable drawer is configured to rest on one of the plurality of foldable shelves when the drawer is in the first configuration; and each of the plurality of foldable shelves is securable to both of the side walls of the main housing when the foldable shelf is in the second position; and a divider having a first edge and a second edge, the divider configured to fit in the foldable drawer when the foldable drawer is in the first expanded configuration such that:

the first edge of the divider contacts a first interior surface of the drawer;

the second edge of the divider contacts a second interior surface of the drawer;

the divider is perpendicular to the bottom of the drawer; and the first interior surface is approximately parallel to the second interior surface.

* * * * *